US006056235A

United States Patent [19]

Brozinsky

[11] Patent Number: 6,056,235

[45] Date of Patent: May 2, 2000

[54] REFILLABLE DISPENSER FOR REPLACING STANDARD ROLL OF TOILET TISSUE WITH ROLL OF PRE-MOISTENED WIPES

[76] Inventor: Steven Brozinsky, 752 Medical Center Ct., Suite 301, Chula Vista, Calif. 91911

[21] Appl. No.: 09/086,686

[22] Filed: May 28, 1998

[51] Int. Cl.[7] ..... B65H 16/06

[52] U.S. Cl. ..... 242/598.6; D6/523

[58] Field of Search ..... 242/588.6, 596.8, 242/597.8, 598, 598.6; D6/522, 523

[56] References Cited

U.S. PATENT DOCUMENTS

| | | | |
|---|---|---|---|
| 573,563 | 12/1896 | Yeakel . | |
| 2,806,738 | 9/1957 | Tsakalas | 299/24 |
| 2,879,932 | 3/1959 | McCachren | 225/89 |
| 3,843,017 | 10/1974 | Harrison | 221/63 |
| 3,994,417 | 11/1976 | Boedecker | 221/48 |
| 3,995,582 | 12/1976 | Douglas | 118/43 |
| 4,004,687 | 1/1977 | Boone | 206/233 |
| 4,034,926 | 7/1977 | Wegner | 242/55.53 |
| 4,106,616 | 8/1978 | Boone | 206/233 |
| 4,106,617 | 8/1978 | Boone | 206/233 |
| 4,462,507 | 7/1984 | Margulies | 221/63 |
| 4,506,801 | 3/1985 | Origuchi | 221/26 |
| 4,535,912 | 8/1985 | Bonk | 221/46 |
| 4,615,442 | 10/1986 | Beeken | 206/397 |
| 4,648,530 | 3/1987 | Granger | 221/34 |
| 4,659,028 | 4/1987 | Wren | 242/55.53 |
| 4,721,264 | 1/1988 | Muscarello | 242/55.53 |
| 4,735,317 | 4/1988 | Sussman et al. | 206/449 |
| 4,936,452 | 6/1990 | Pauley | 206/390 |
| 5,439,521 | 8/1995 | Rao | 242/598.6 |
| 5,660,313 | 8/1997 | Newbold | 242/598.6 |
| 5,697,577 | 12/1997 | Ogden | 242/598.6 |
| 5,897,074 | 4/1999 | Marino | 242/598.6 |

FOREIGN PATENT DOCUMENTS 025549 7/1987 Germany .

*Primary Examiner*—John Q. Nguyen
*Attorney, Agent, or Firm*—Richard L. Miller P.E Registered Patent Agent

[57] ABSTRACT

A refillable dispenser for replacing a standard roll of toilet tissue on a standard pre-existing roll-type toilet-tissue holder with a roll or selectively dispensable pre-moistened wipes replaceably contained therein so as to allow the roll of selectively dispensable pre-moistened wipes to be readily available in virtually any bathroom and ensure its reliable and regular use instead of the standard roll of toilet tissue. The dispenser includes a hollow housing for containing the roll of selectively dispensable pre-moistened wipes, and a core that passes freely through the core of the roll of selectively dispensable pre-moistened wipes for rotative motion therebetween and for non-rotatively receiving the spindle of the standard pre-existing roll-type toilet-tissue holder. The core is hollow and extends axially, concentrically, and completely through, the housing. When sized appropriately, the refillable dispenser can also be used for replacing a standard roll of paper toweling on a standard pre-existing roll-type paper-towel holder with a roll of selectively dispensable pre-moistened paper toweling replaceably contained therein so as to allow the roll of selectively dispensable pre-moistened paper toweling to be readily available in virtually any kitchen and ensure its reliable and regular use instead of the standard roll of paper toweling.

36 Claims, 4 Drawing Sheets

REFILLABLE DISPENSER FOR REPLACING STANDARD ROLL OF TOILET TISSUE WITH ROLL OF PRE-MOISTENED WIPES

BACKGROUND OF THE INVENTION

1. Field of the Invention

The present invention relates to a dispenser. More particularly, the present invention relates to a refillable dispenser for replacing a standard roll of toilet tissue on a standard pre-existing roll-type toilet-tissue holder with a roll of selectively dispensable pre-moistened wipes replaceably contained therein.

2. Description of the Prior Art

The configuration of the pertinent components of a standard roll-type toilet-tissue holder 1 with a standard roll of toilet tissue 2 thereon can best be seen in FIG. 1, and as such, will be discussed with reference thereto for their critical relevance to the present invention.

The standard roll-type toilet-tissue holder 1 comprises a pair of posts 3. Each post of the pair of posts 3 of the standard roll-type toilet-tissue holder 1 has a proximal end 4 that attaches to a wall 5 and a distal end 6 that extends away from the wall 5.

The pair of posts 3 of the standard roll-type toilet-tissue holder 1 are substantially parallel and spaced approximately 13 cm apart, and extend substantially perpendicularly from the wall 5.

The apparatus for attaching the pair of posts 3 of the standard roll-type toilet-tissue holder 1 to the wall 5 varies, but is of no relevance to the discussion of the present invention.

The standard roll-type toilet-tissue holder 1 further comprises a spindle 7 that has a diameter of approximately 2.5 cm. The spindle 7 of the standard roll-type toilet-tissue holder 1 extends from the distal end 6 of one post of the pair of posts 3 of the standard roll-type toilet-tissue holder 1, to the distal end 6 of the other post of the pair of posts 3 of the standard roll-type toilet-tissue holder 1, with at least one end of the spindle 7 of the standard roll-type toilet-tissue holder 1 being replaceably mounted to the distal end 6 of an associated post of the pair of posts 3 of the standard roll-type toilet-tissue holder 1 so as to allow the spindle 7 of the standard roll-type toilet-tissue holder 1 to be removed and placed through the standard roll of toilet tissue 2.

The standard roll of toilet tissue 2 is approximately 11 cm in length and has a hollow axial core 7 with a diameter of approximately 4.5 cm so as to allow the standard roll of toilet tissue 2 to rotate freely on the spindle 7 of the standard roll-type toilet-tissue holder 1.

An assortment of devices have been proposed for dispensing pre-moistened towelettes. In such devices, a supply of the moist towelettes is normally retained in a sealed container, protected from exposure to open air to prevent evaporation of the moisture and drying of the towelette. The toilettes are withdrawn from the receptacle for use.

Many uses for pre-moistened wipes have been identified for the home and commercial environment, but experience with the aging population of gastroenterological patients over recent years has demonstrated a continuing and pressing need for a pre-moistened wipe dispenser for use in personal hygiene that can be conveniently installed for regular use. The products currently available in the art do not meet this need, because they are not convenient enough to encourage regular use by those individuals and patients who most need them.

Numerous innovations for dispensers have been provided in the prior art that will be described. Even though these innovations may be suitable for the specific individual purpose. to which they address, however, they differ from the present invention in that they are not designed to conveniently and immediately replace a standard roll of toilet paper in a bathroom with a roll of pre-moistened wipes, without any modification to the standard roll-type toilet-tissue holder.

FOR EXAMPLE, U.S. Pat. No. 573,563 to Yeakel teaches a casing having a closed and an open end and a longitudinally-extending slot with a widened end, a spool-holding spindle secured to the closed end, a cap for the open end of the casing, a cutter on the cap, and a spring on the spindle, adapted to press the spool in the direction toward the cutter, the widened end of the slot being adjacent to the cutter.

ANOTHER EXAMPLE, U.S. Pat. No. 2,806,738 to Tsakalas teaches a dispenser for a roll of paper. The dispenser comprises a casing having a cylindrical side wall, an end wall and an opening opposite to the end wall, the cylindrical side wall having overlapping spaced portions defining a passage through which the paper is adapted to be withdrawn, a closure operatively connected to the casing and adapted to close the open end of the casing, the closure having an inner surface which forms a stop for the roll of paper preventing its movement in one direction in the casing, a hollow spindle attached to the wall of the casing on which the roll of paper is adapted to be mounted for rotation, the hollow spindle having apertures, a valve adapted to register with the apertures in order to control the effective size thereof, the valve having a chamber in which to accommodate a deodorant.

STILL ANOTHER EXAMPLE, U.S. Pat. No. 2,879,932 to McCachren teaches a holder for a roll of sheet material comprising a support engaging portion, an L-shaped releasing arm hingedly secured to the support engaging portion, the support engaging portion and the releasing arm having companion roll supporting elements, an upstanding bracket carried by the releasing arm for engagement by an operator to swing the releasing arm away from a roll of sheet material normally supported by the support engaging portions and the releasing arm to swing the roll supporting element of the releasing arm out of engagement with a roll supported thereby for removal or replacement of the roll. The L-shaped releasing arm is hingedly connected to the engaging portion at a point intermediate the lateral surface of the roll thereby providing forward aligned edges for facilitating the tearing of sheets of material from the roll when a sheet is pulled against the forward aligned edges.

YET ANOTHER EXAMPLE, U.S. Pat. No. 3,472,634 to Sloan teaches a device for holding a roll of sheet material having a axial opening, a container having a cylindrical wall and two ends, one end comprising a cap telescoping with the wall, a hub on each of the ends fitting in the opening, and cam means on the cap and wall for clamping the roll between the ends. The cam means has a surface which inclines axially of the roll to draw the ends together by turning the cap from unclamped to clamped position. The means comprises cams distributed around the wall and cam followers on the cap, with the cap being flexible, so that the followers can snap over the cams.

STILL YET ANOTHER EXAMPLE, U.S. Pat. No. 3,843,017 to Harrison teaches a dispenser for a treated perforated tissue web, wherein the dispenser is provided with an opening for extraction of the web from the dispenser. The opening has associated therewith an interior flap which normally all but closes the opening through which the web is withdrawn thereby providing sufficient tension on the web to cause it to tear off at the perforations. A variation includes a form in which the flap is such that it completely closes and overlaps the opening in the dispenser forcing the web to travel in a tortuous path.

YET STILL ANOTHER EXAMPLE, U.S. Pat. No. 3,994, 417 to Boedecker teaches a dispenser for pre-moistened towelettes comprising a container having a cavity, and opening means for passage of the towelettes from the cavity toward the outside of the container. The dispenser has a supply of pre-moistened absorbent material disposed in the container cavity. The dispenser also has a floating barrier movably positioned in the cavity intermediate the supply and the opening means, with the barrier having aperture means for passage of the supply through the barrier to the opening means.

The dispenser, however, is of a generally rectangular box-like shape and is therefore unsuited for fitting over a standard toilet roll holder.

STILL YET ANOTHER EXAMPLE, U.S. Pat. No. 3,995, 582 to Douglas teaches a dispensing package that comprises a toroidal container body enclosing a coreless rolled web of moisture absorbent material having free rotation about the axis of the body on body side wall areas of reduced diameter at opposite ends of a liquid reservoir. The leading end of the web is drawn through a longitudinal slot in a body side wall extending the full width of the web and through upper and lower flange lips defining with the slot a dispensing passage.

Even though a dispensing opening is provided in the side of the container, it is not designed, however, for mounting on a central dowel.

YET STILL ANOTHER EXAMPLE, U.S. Pat. No. 4,004, 687 to Boone teaches a compact device easily attached by sliding it onto one post of a standard roll-type toilet-tissue holder for positioning a container of a material particularly usable for health care or personal hygiene purposes at the location, e.g., a material such as pre-wetted or self-wetting sheets, an encapsulated liquid, a pressurized liquid, etc., and holding the container in a given manner pending or during its usage.

The device is intended for use in addition to the dry toilet roll, however, and does not replace the standard roll, because the container is not designed for fitting on the toilet paper roll holder dowel.

If the gastroenterological patient is willing to maintain both a normal toilet roll and the adjacent wipe dispenser described by Boone in every area of his environment to insure availability of the necessary personal hygiene, then Boone's container would meet the personal hygiene needs of such patients adequately.

Unfortunately, the typical patient will not reliably adjust his routine to use such a custom installation and will not reliably make the extra effort needed to maintain two separate personal hygiene dispensing arrangements in every area of his environment. Because of the inconvenience, the typical patient may suffer additional medical problems resulting from personal hygiene inadequate for his medical condition.

STILL YET ANOTHER EXAMPLE, U.S. Pat. No. 4,034, 926 to Wegner teaches a container and dispenser for a rolled sheet of gauze material which permits a user to dispense a selected length of gauze without touching the surface of the gauze during the dispensing operation, and which prevents the dispensing of additional gauze at other times.

YET STILL ANOTHER EXAMPLE, U.S. Pat. No. 4,106, 616 to Boone teaches a device readily attachable to a standard toilet-tissue dispenser of a roll type for positioning adjacent thereto in visual alignment supplemental material such as a container of pre-wetted toilet sheets. The sheets are manually withdrawable from an aperture which is held firmly at a fixed position to assure their ready withdrawal and consistent location.

The device is intended for use in addition to the dry toilet roll, however, and does not replace the standard roll, because the container is not designed for fitting on the toilet paper roll holder dowel.

If the gastroenterological patient is willing to maintain both a normal toilet roll and the adjacent wipe dispenser described by Boone in every area of his environment to insure availability of the necessary personal hygiene, then Boone's container would meet the personal hygiene needs or such patients adequately.

Unfortunately, the typical patient will not reliably adjust his routine to use such a custom installation and will not reliably make the extra effort needed to maintain two separate personal hygiene dispensing arrangements in every area of his environment. Because of the inconvenience, the typical patient may suffer additional medical problems resulting from personal hygiene inadequate for his medical condition.

STILL YET ANOTHER EXAMPLE, U.S. Pat. No. 4,136, 617 to Boone teaches a unitary multipurpose bathroom fixture for making available both conventional dry sheets of toilet-tissue from a roll carried by a spindle component and supplemental pre-moistened sheets from a container component. A first fastening means, exclusively serving an engaging purpose, is integral with portions supporting the spindle component. A second fastening means, also exclusively serving an engaging function, is integral with the container component. The two fastening means are adapted to effect a firm engagement with one another and thus to provide the unitary fixture. Also, included are means for determining the direction of withdrawal of the pre-moistened sheets to insure their individual availability and to prevent dislodgement or the container. Other means relate to convenience and economy in supplying the pre-moistened sheets.

YET STILL ANOTHER EXAMPLE, U.S. Pat. No. 4,462, 507 to Margulies teaches a dispensing closure for closing an end of a canister containing dispensable articles that includes a top adapted to fit over an open end of a canister. The top has depending therefrom an integral peripheral axial flange. The top has therein a dispensing opening and a slit connected with the dispensing opening. The closure may be originally provided with the dispensing opening, or alternatively, the closure may be originally provided with a tear-out member which is removed by the consumer to form the dispensing opening. The dispensing opening and slit may be formed directly in the top, or alternatively, the top may have a recess defined by a bottom wall and a side wall, with the dispensing opening and slit being formed in the bottom wall of the recess. A lid is selectively movable between a first position covering the top or fitted within the recess and a second position removed from the top or recess. The lid includes a first portion adapted to cover the tear-out member or the dispensing opening when the lid is in the first position thereof. The lid includes a second portion adapted to cover the slit when the lid is in the first position thereof. The second portion of the lid is integrally but flexibly connected to the first portion of the lid, such that when the lid is in the first position thereof the second portion of the lid is selectively pivotable with respect to the first portion of the lid away from the top, thereby to uncover the slit.

STILL YET ANOTHER EXAMPLE, U.S. Pat. No. 4,506, 801 to Origuchi teaches a construction for holding a bag-shaped or sheet-shaped continuous plastic film. In this holding construction, the plastic film is folded in a Z-shaped manner, such that linear cuts formed in the continuous plastic film are accurately superposed on one another, and at least portions of insert members are inserted into the plastic film or the insert members are entirely inserted through the plastic film so as to retain the plastic film in a bundled stated. If one end portion of the film is drawn out, then a section of a predetermined length of the film is torn off along the linear cut or cuts by means of the insert members, and when the section of the film is torn off, an end portion of the succeeding, i.e. second section of the film, is automatically drawn out to a position corresponding to the position where the end portion of the first section of the film was initially positioned, through the action of connecting portions other than the linear cut or cuts, so that the construction, in which the plastic film can be easily used one section after another in the same manner as is the pop-up takeout method of tissue paper, can be obtained.

YET STILL ANOTHER EXAMPLE, U.S. Pat. No. 4,535, 912 to Bonk teaches a towelette dispenser and vapor impervious pouch containing a roll or web of absorbent material, such as non-woven fibrous towelettes pre-moistened with a chemical-containing aqueous or other fluid solution. The pouch is sealed before use to prevent the loss of moisture from the pre-moistened towelette roll and is opened at the point of, and at the time of, first use. A double lid is adapted to provide moisture seal between usages of the pre-moistened towelette, while reducing dehydration of the opened towelette pouch within the dispenser. Feed slit adaptations in the lid provide for selective tearability of individual towelette portions from the roll. The dispenser is adapted to provide a low center of gravity, and the base of the dispenser can cooperatingly engage a wall-type holder. The towelette roll contains a leader adapted for ease of feeding through the feed slot upon first use. The web may be folded parallel to the longitudinal axis to provide larger towelettes and improve ease of withdrawal from the dispenser.

Even though the dispenser can be wall-mounted on a suitable holder, it is, however, unsuited for fitting over a standard toilet roll holder dowel.

STILL YET ANOTHER EXAMPLE, U.S. Pat. No. 4,615, 442 to Beeken teaches a cylindrical receptacle for holding a winding of sheet material with a hollow core, such as toilet paper or paper towels, that has a central fixed guide member, a sliding guide member, retainers to keep the sliding guide member from disengaging the fixed guide member and to keep the winding from sliding off the sliding guide member, and a cap to close the open end of the cylindrical receptacle. The joining or the cap and receptacle body can be made water proof to keep the contents dry. A hanger can be attached to the closed end of the cylindrical receptacle, so that the open end hangs downward allowing the paper roll to slide out of the cylinder, yet be retained by the sliding member and retainer in such a manner as to allow easy unrolling of the paper roll.

YET STILL ANOTHER EXAMPLE, U.S. Pat. No. 4,648, 530 to Granger teaches an automatic dispenser for ore-cut Z-folded web materials, wherein the dispenser comprises a holder or support having an orifice through which the web materials are pulled. The orifice has outwardly rounded edges, so that the web can be pulled with unequal pulling forces and from different directions. In some embodiments, the orifice is provided with an obturator having two opening elements that are elastically coupled to one another. The obturator has round edges through which the web passes, wherein one of the edges can be separated from the other.

Even though the dispenser may be mounted on the wall, it will, however, not fit over a standard toilet roll holder dowel.

STILL YET ANOTHER EXAMPLE, U.S. Pat. No. 4,659, 028 to Wren teaches a portable dispenser for rolled perforated toilet tissues comprising a base adapted to receive a roll in rotatable condition and an outlet structure comprising a tissue-constricting ring through which the tissue is fed and which provides sufficient friction to prevent back,up of the tissue into the dispenser. A bill-like projection extends outwardly from the bottom of the aperture or ring to assist in breaking the tissues from one another along a line of perforation. A box-like cover fits over the entire assembly to improve aesthetics.

YET STILL ANOTHER EXAMPLE, U.S. Pat. No. 4,721, 264 to Muscarello teaches an accessory for a conventional toilet tissue roll holder and an integrated dispensing assembly operating on the same principal. Each is adapted to prevent unauthorized access to a toilet tissue roll by a child who might unroll the tissue in an uncontrolled manner. The accessory includes a stationary component in the form of an incomplete cylinder and has a coupling region which is rectangular and flattened and includes a pair of spaced apart elongated apertures. The first component also has a pair of circumferentially extending guides disposed proximate its ends. A movable component is also generally in the form of an incomplete cylinder and includes first and second circumferentially flanges with the respective distances between the guides and the flanges, such as to permit them to slidably cooperate in a manner which permits rotation of the second component coaxially within the first component between alternative protected (closed) and unprotected (open) positions. Securement apparatus for detachably fixing the second component in the protected position is provided. The integral dispensing assembly counterpart further includes, with the stationary component, a rectangular coupling region peripherally extending about the stationary component to permit affixing the assembly to the recessed within a wall.

STILL YET ANOTHER EXAMPLE, U.S. Pat. No. 4,735, 317 to Sussman et al. teaches a dispenser for providing access to a plurality of pre-moistened towelettes and having dual orifices covered by a self-sealing lid. A larger recessed orifice in the top side of the container accommodates a smaller opening and both openings are covered by a lid attached to a ledge surrounding the larger recessed orifice perimeter. The lid has approximately the same planar dimensions as the combination planar dimensions of the recess and ledge and is held in a closed position by press fitting under an outer border curbing the perimeter of the outermost edge of the ledge. A removable back panel is provided for ease of refilling prepackaged towelettes in the dispenser, and a second back attachment means is provided for attaching or mounting the dispenser to a flat surface.

Even though the pack may be wall-mounted, it is unsuited, however, for fitting over a standard toilet roll holder dowel.

YET STILL ANOTHER EXAMPLE, U.S. Pat. No. 4,936, 452 to Pauley teaches a bathroom tissue container, wherein an elongate tubular support member includes an elongate slot therein with a threaded cap securably mounted to the support member overlying the slot. The slot includes a fixed serrated clamp and a movably mounted serrated clamp to either side of the slot to maintain tissue removed from within the container and prevent such tissue from withdrawal into the container. The movable serrated clamp includes a spring-biased cylindrical guide movably mounted relative to an interior wall of the container, adjacent the slot to maintain a smooth presentation of tissue for removal. The threaded closure includes an interior portion of resilient cushion with a smooth polymeric abutment disk to maintain the tissue in alignment with the container and resiliently bias a roll of tissue within the container during use.

FINALLY, STILL YET ANOTHER EXAMPLE, German Patent No. 89-025549/04 to Krieger teaches rolls of paper or foils of metal or plastic, e.g. toilet rolls or other rolls of kitchen foil, are stored both for current and for later use not on brackets and bobbins, but by keeping them inside a strip of textile or plastic foil which is attached in a loop by a Velcro(™) fastener to the wall. The two ends are likewise connected and separated by a Velcro(™) fastener.

It is apparent that numerous innovations for dispensers have been provided in the prior art that are adapted to be used. Furthermore, even though these innovations may be suitable for the specific individual purposes to which they address, however, they would not be suitable for the purposes of the present invention as heretofore described.

As will be appreciated from the discussion of related art supra, a pre-moistened wipe dispenser suitable for convenient installation in a standard toilet roll holder is unknown in the art.

Experience in the medical profession shows that the patient most in need of the personal hygiene enhancement available from pre-moistened towelettes will not reliably use such towelettes when they are not available from a convenient dispenser requiring no custom installation.

By replacing the standard toilet roll with such a dispenser, the patient is encouraged to adjust the practice of personal hygiene to that required for his medical condition.

SUMMARY OF THE INVENTION

The dimensions of the present invention are selected to fit into the space that is currently occupied by a roll of dry toilet paper. Although a roll of pre-moistened wipes may contain fewer sheets than a typical dry roll of toilet paper, the user will need fewer sheets and the moistened roll should last even longer than a dry roll.

It is an important feature of the present invention that in use the pre-moistened wipe dispenser replaces, and is not in addition to, the present dry roll of toilet paper; the dispenser itself is suspended on the standard dowel and the wipes within are gently unrolled. This insures the reliable and regular use of pre-moistened wipes instead of dry toilet paper for personal hygiene, as is necessary for many individuals having certain medical reasons for enhanced personal hygiene.

ACCORDINGLY, AN OBJECT of the present invention is to provide a refillable dispenser for replacing a standard roll of toilet tissue on a standard pre-existing roll-type toilet-tissue holder with a roll of selectively dispensable pre-moistened wipes replaceably contained therein that avoids the disadvantages of the prior art.

ANOTHER OBJECT of the present invention is to provide a refillable dispenser for replacing a standard roll of toilet tissue on a standard pre-existing roll-type toilet-tissue holder with a roll of selectively dispensable ore-moistened wipes replaceably contained therein that is simple and inexpensive to manufacture.

STILL ANOTHER OBJECT of the present invention is to provide a refillable dispenser for replacing a standard roll of toilet tissue on a standard pre-existing roll-type toilet-tissue holder with a roll of selectively dispensable pre-moistened wipes replaceably contained therein that is simple to use.

BRIEFLY STATED, YET ANOTHER OBJECT of the present invention is to provide a refillable dispenser for replacing a standard roll of toilet tissue on a standard pre-existing roll-type toilet-tissue holder with a roll of selectively dispensable pre-moistened wipes replaceable contained therein so as to allow the roll of selectively dispensable pre-moistened wipes to be readily available in virtually any bathroom and ensure its reliable and regular use instead of the standard roll of toilet tissue. The dispenser includes a hollow housing for containing the roll of selectively dispensable ore-moistened wipes, and a core that passes freely through the core of the roll of selectively dispensable pre-moistened wipes for rotative motion therebetween and for non-rotatively receiving the spindle of the standard pre-existing roll-type toilet-tissue holder. The core is hollow and extends axially, concentrically, and completely through, the housing. When sized appropriately, the refillable dispenser can also be used for replacing a standard roll of paper toweling on a standard pre-existing roll-type paper-towel holder with a roll of selectively dispensable pre-moistened paper toweling replaceably contained therein so as to allow the roll of selectively dispensable pre-moistened paper toweling to be readily available in virtually any kitchen and ensure its reliable and regular use instead of the standard roll of paper toweling.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows.

LIST OF REFERENCE NUMERALS UTILIZED IN THE DRAWING

Prior Art

1 standard roll-type toilet-tissue holder

2 standard roll of toilet tissue

Figure 1:
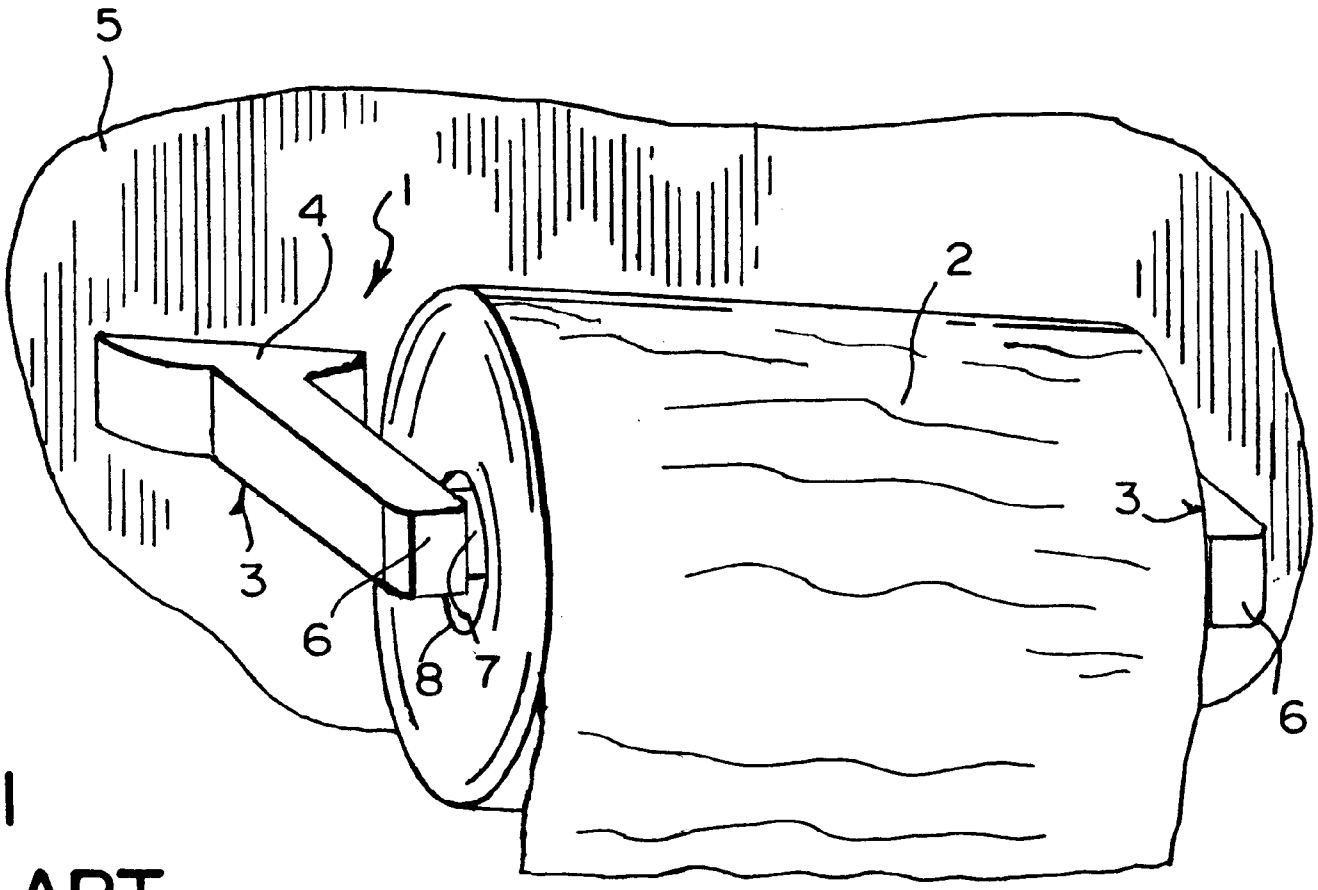
FIG. 1 PRIOR ART
FIG. 1 is a diagrammatic perspective view of a standard roll of toilet tissue on a standard roll-type toilet-tissue holder of the prior art.

3 pair of posts of standard roll-type toilet-tissue holder 1

4 proximal end of each post of pair of posts 3 of standard roll-type toilet-tissue holder 1 for attaching to wall 5

5 wall

6 distal end of each post of pair of posts 3 of standard roll-type toilet-tissue holder 1 for extending away from wall 7

7 spindle of standard roll-type toilet-tissue holder 1

8 hollow axial core or standard roll of toilet tissue 2

First Embodiment

10 refillable dispenser for replacing a standard roll of toilet tissue on a standard pre-existing roll-type toilet-tissue holder with a roll of selectively dispensable pre-moistened wipes replaceably contained therein of present invention

14 housing of refillable dispenser for replacing a standard roll of toilet tissue on a standard pre-existing roll-type toilet-tissue holder with a roll of selectively dispensable pre-moistened wipes replaceably contained therein 10

16 roll of selectively dispensable pre-moistened wipes of refillable dispenser for replacing a standard roll of toilet tissue on a standard pre-existing roll-type toilet-tissue holder with a roll of selectively dispensable pre-moistened wipes replaceably contained therein 10

17 hermetically sealed package containing roll of selectively dispensable pre-moistened wipes 16

18 core of refillable dispenser for replacing a standard roll of toilet tissue on a standard ore-existing roll-type toilet-tissue holder with a roll of selectively dispensable pre-moistened wipes replaceably contained therein 10

20 core of roll of selectively dispensable pre-moistened wipes 16

22 long component of housing 14

24 short component of housing 14

26 first apparatus for selectively opening housing 14 for placement of roll of selectively dispensable pre-moistened wipes 16 therein

28 innermost end of long component 22 of housing 14

30 circumferential rim defining innermost end 28 of long component 22 of housing 14

32 outermost end wall of long component 22 of housing 14

34 throughbore in outermost end wall 32 of long component 22 of housing 14 through centerline 36 of long component 22 of housing 14

35 perimeter of throughbore 34 in outermost end wall 32 of long component 22 of housing 14

36 centerline of long component 22 of housing 14

38 circumferential ring on circumferential rim 30 of innermost end 28 of long component 22 of housing 14

40 outermost surface of long component 22 of housing 14

42 innermost end of short component 22 of housing 14

44 circumferential rim defining innermost end 42 of short component 22 of housing 14

46 outermost end wall of short component 22 of housing 14

48 throughbore in outermost end wall 46 of short component 22 of housing 14 through centerline 50 of short component 22 of housing 14

49 perimeter of throughbore 48 in outermost end wall 46 of short component 22 of housing 14

50 centerline of short component 22 of housing 14

52 circumferential detent in circumferential rim 44 of innermost end 42 of short component 24 of housing 14

54 outermost surface of short component 24 of housing 14

56 long component of core 18

58 short component of core 18

60 second apparatus for selectively opening core 18 for placement of roll of selectively dispensable pre-moistened wipes 16 in housing 14

62 outermost end of long component 56 of core 18

64 innermost end of long component 56 of core 18

66 circumferential rim defining innermost end 64 of long component 56 of core 18

68 circumferential ring on circumferential rim 66 of innermost end 64 of long component 56 of core 18

70 outermost surface of long component 56 of core 18

72 outermost end of short component 58 of core 18

74 innermost end of short component 58 of core 18

76 circumferential rim defining innermost end 74 of short component 58 of core 18

78 circumferential detent in circumferential rim 76 on innermost end 74 of short component 58 of core 18

80 outermost surface of short component 58 of core 18

82 throughbore extending laterally through long component 22 of housing 14 for dispensing roll of selectively dispensable pre-moistened wipes 16 therefrom

83 perimeter of throughbore 82 extending laterally through long component 22 of housing 14 for dispensing roll of selectively dispensable pre-moistened wipes 12 therefrom

84 lip on long component 22 of housing 14

86 snap-on cap of long component 22 of housing 14

87 molded hinge

Second Embodiment

110 refillable dispenser for replacing a standard roll of toilet tissue on a standard pre-existing roll-type toilet-tissue holder with a roll of selectively dispensable pre-moistened wipes replaceably contained therein of the present invention

114 housing of refillable dispenser for replacing a standard roll of toilet tissue on a standard pre-existing roll-type toilet-tissue holder with a roll of selectively dispensable pre-moistened wipes replaceable contained therein 110

118 core of refillable dispenser for replacing a standard roll of toilet tissue on a standard pre-existing roll-type toilet-tissue holder with a roll of selectively dispensable pre-moistened wipes replaceably contained therein 110

122 long component of housing 114

124 short component of housing 114

126 first apparatus

142 innermost end of short component 124 of housing 114

144 circumferential rim defining innermost end 142 of short component 124 of housing 114

152 circumferential detent in circumferential rim 144 of innermost end 142 of short component 124 of housing 114

156 long component of core 118

158 short component of core 118

160 second apparatus

174 innermost end 174 of short component 158 of core 118

176 circumferential rim defining innermost end 174 of short component 158 of core 118

178 circumferential detent in circumferential rim 176 of innermost end 174 of short component 158 of core 118

188 O-ring of first apparatus 126 in circumferential detent 152 in circumferential rim 144 of innermost end 142 of short component 124 of housing 114

189 O-ring of second apparatus 160 in circumferential detent 178 in circumferential rim 176 of innermost end 174 of short component 158 of core 118

190 hinge

192 latch

194 catch

Third Embodiment

210 refillable dispenser for replacing a standard roll of toilet tissue on a standard pre-existing roll-type toilet-tissue holder with a roll of selectively dispensable pre-moistened wipes replaceably contained therein of the present invention

214 housing

218 core

222 long component of housing 214

224 short component of housing 214

226 first apparatus of housing 214

228 innermost end of long component 222 of housing 214

230 circumferential rim defining innermost end 228 of long component 222 of housing 214

238 self-sealing female threads around circumferential rim 230 of innermost end 228 of long component 222 of housing 214

242 innermost end of short component 224 of housing 214

244 circumferential rim defining innermost end 242 of short component 224 of housing 214

252 self-sealing male threads around circumferential rim 244 of innermost end 242 of short component 224 of housing 214

256 long component of core 218

258 short component of core 218

260 second apparatus of core 218

264 innermost end of long component 256 of core 218

266 circumferential rim defining innermost end 264 of long component 256 of core 218

268 self-sealing female threads around circumferential rim 266 of innermost end 264 of long component 256 of core 218

274 innermost end of short component 258 of core 218

276 circumferential rim defining innermost end 274 of short component 258 of core 218

278 self-sealing male threads around circumferential rim 276 of innermost end 274 of short component 258 of core 218

Fourth Embodiment

310 refillable dispenser for replacing a standard roll of toilet tissue on a standard pre-existing roll-type toilet-tissue holder with a roll of selectively dispensable pre-moistened wipes replaceably contained therein of the present invention

314 housing core

322 long component of housing 314

324 short component of housing 314

332 outermost end wall of long component 322 of housing 314

346 outermost end wall of short component 324 of housing 314

356 long component of core 318

358 short component of core 318

396 long dowel

398 short dowel

Fifth Embodiment

410 refillable dispenser for replacing a standard roll of toilet tissue on a standard pre-existing roll-type toilet-tissue holder with a roll of selectively dispensable pre-moistened wipes replaceably contained therein of the present invention

486 cap

487 star-489 very thin arms of cap 486

489 very thin arms of star-shaped throughslit 487 in cap 486

DESCRIPTION OF THE PREFERRED EMBODIMENT

Figure 2:
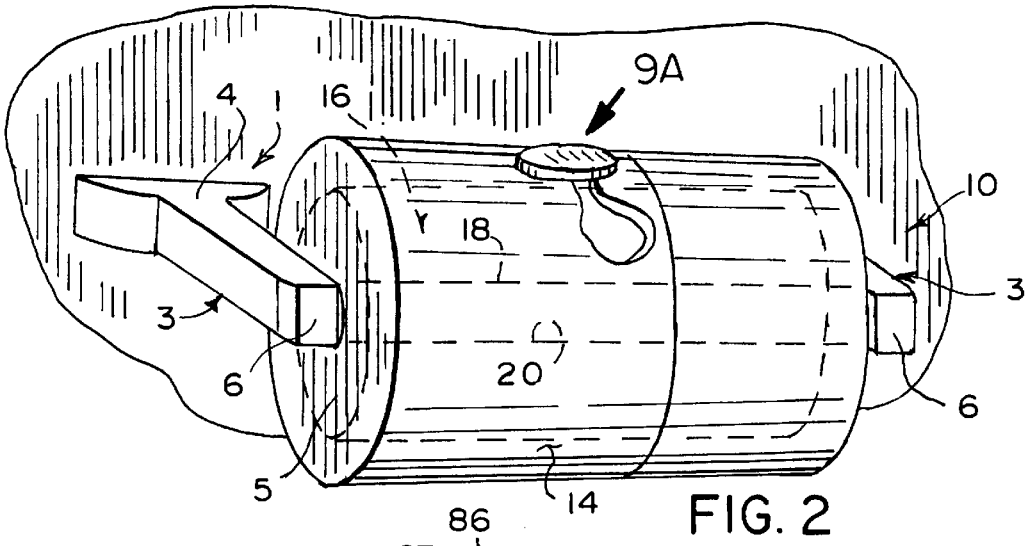
FIG. 2 is a diagrammatic perspective view of the present invention replacing the standard roll of toilet tissue on the standard roll-type toilet-tissue holder.

Referring now to the figures, in which like numerals indicate like parts, and particularly to FIG. 2, the first embodiment of the refillable dispenser for replacing a standard roll of toilet tissue on a standard pre-existing roll-type toilet-tissue holder with a roll of selectively dispensable pre-moistened wipes replaceably contained therein of the present invention is shown generally at 10 for replacing a standard roll of toilet tissue 2 on a standard pre-existing roll-type toilet-tissue holder 1 with a roll of selectively dispensable pre-moistened wipes 12 replaceably contained therein so as to allow the roll of selectively dispensable pre-moistened wipes to be readily available in virtually any bathroom and ensure its reliable and regular use instead of the standard roll of toilet tissue 2.

The configuration of the refillable dispenser for replacing a standard roll of toilet tissue on a standard pre-existing roll-type toilet-tissue holder with a roll of selectively dispensable pre-moistened wipes replaceably contained therein 10 can best be seen in FIGS. 2–5, and as such will be discussed with reference thereto.

The refillable dispenser for replacing a standard roll of toilet tissue on a standard pre-existing roll-type toilet-tissue holder with a roll of selectively dispensable pre-moistened wipes replaceably contained therein 10 comprises a housing 14 that is hollow for containing a roll of selectively dispensable pre-moistened wipes 16 (see FIG. 3) that are flushable and biodegradable.

The refillable dispenser for replacing a standard roll of toilet tissue on a standard pre-existing roll-type toilet-tissue holder with a roll of selectively dispensable pre-moistened wipes replaceably contained therein 10 further comprises a core 18 of passing freely through a core 20 of the roll of selectively dispensable pre-moistened wipes 16 (see FIG. 3) for rotative motion therebetween and for non-rotatively receiving the spindle 7 of the standard pre-existing roll-type toilet-tissue holder 1, and which is hollow and extends axially, concentrically, and completely through, the housing 14.

The roll of selectively dispensable pre-moistened wipes 16 is a continuous sheet of fibrous wiping textile having a width of approximately 10 cm, with its core 20 having a diameter of approximately 4.5 cm for allowing free rotation of the roll of selectively dispensable pre-moistened wipes 16 on the core 18.

The housing 14 and the core 18 are injection molded from a material that is compatible with, and not permeable for, the liquid of the roll of selectively dispensable pre-moistened wipes 16, and yet maintains a dimensionally-stable component.

Figure 3:
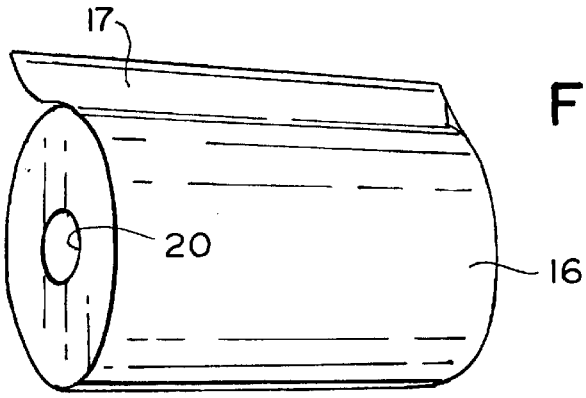
FIG. 3 is a diagrammatic perspective view of a roll of pre-moistened wipes for use with the present invention.

As shown in FIG. 3, the roll of selectively dispensable pre-moistened wipes 16 is contained in a hermetically sealed package 17, prior to use to prevent it from drying out, and is divided by regularly-spaced full width perforations thereacross to form a roll of individual separable wipes with leading edges.

Figure 4:
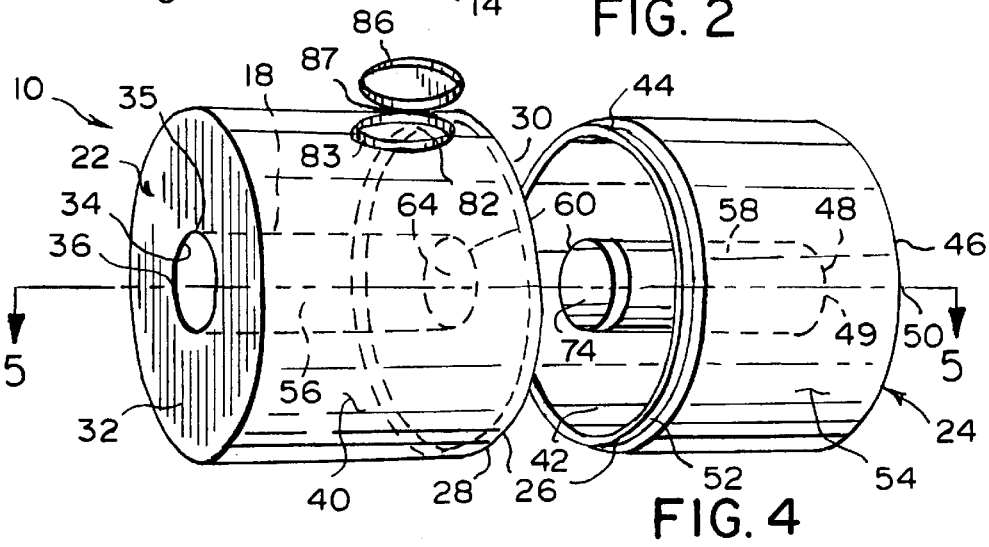
FIG. 4 is a diagrammatic exploded perspective view of a first embodiment of the present invention.
Figure 5:
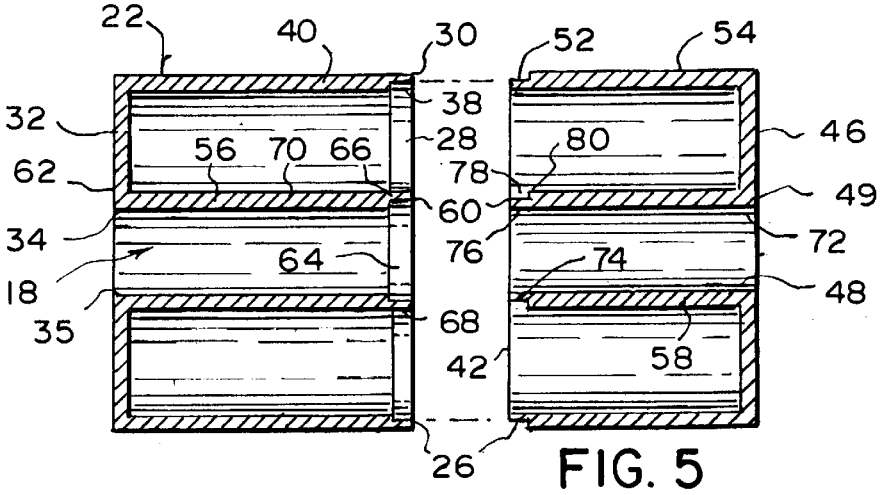
FIG. 5 is a cross sectional view taken on line 5—5 in figure 4.

As shown in FIGS. 4 and 5, the housing 14 is circular-cylindrically-shaped for substantially replicating the standard roll of toilet tissue 2. The housing 14 has a length of approximately 12 cm for fitting between the pair of posts 3 of the standard pre-existing roll-type toilet-tissue holder 1, which as mentioned supra, are spaced approximately 13 cm apart, and to also further substantially replicate the standard roll of toilet tissue 2, which as mentioned supra, is approximately 11 cm in length. The approximate 12 cm length of the housing 14 is therefore critical and does deserve patentable weight, since it allows the housing 14 to fit between the pair of posts 3 of the standard pre-existing roll-type toilet-tissue holder 1 and further substantially replicate the standard roll of toilet tissue 2.

The housing 14 is divided into a long component 22 and a short component 24, which is shorter than, detachably attached to, and axially-aligned with, the long component 22 of the housing 14, by a first apparatus 26 for selectively opening the housing 14 for placement of the roll of selectively dispensable pre-moistened wipes 16 therein.

To maintain the circular cylindrical shape of the housing 14, each of the long component 22 of the housing 14 and the short component 24 of the housing 14 is also circular-cylindrically-shaped.

The long component 22 of the housing 14 is hollow, and has a length, an innermost end 28 that is opened and defined by a circumferential rim 30, and an outermost end wall 32 that is circular-shaped and has a throughbore 34 that extends axially through its centerline 36 with a diameter and a perimeter 35.

The diameter of the throughbore 34 in the outermost end wall 32 of the long component 22 of the housing 14 is approximately 2.5 cm for the snug and non-rotative reception of the spindle 7 of the standard pre-existing roll-type toilet-tissue holder 1. The approximate 2.5 cm diameter of the throughbore 34 in the outermost end wall 32 of the long component 22 of the housing 14 is therefore critical and does deserve patentable weight, since it prevents the long component 22 of the housing 14 from rotating on the spindle 7 of the standard pre-existing roll-type toilet-tissue holder 1 during use.

The first apparatus 26 of the housing 14 includes the circumferential rim 30 of the innermost end 28 of the long component 22 of the housing 14 having a circumferential ring 38 that extends axially therefrom and circumferentially therearound, flush with its outermost surface 40.

The short component 22 of the housing 14 is hollow, and has a length, an innermost end 42 that is opened and defined by a circumferential rim 44, and an outermost end wall 46 that is circular-shaped and has a throughbore 48 that extends axially through its centerline 50 with a diameter and a perimeter 49, with the centerline 50 of the short component 24 of the housing 14 being collinear with the centerline 36 of the long component 22 of the housing 14.

The diameter of the throughbore 48 in the outermost end wall 46 of the short component 24 of the housing 14 is approximately 2.5 cm for the snug and non-rotative reception of the spindle 7 of the standard pre-existing roll-type toilet-tissue holder 1. The approximate 2.5 cm diameter of the throughbore 48 in the outermost end wall 46 of the short component 24 of the housing 14 is therefore critical and does deserve patentable weight, since it prevents the short component 24 or the housing 14 from rotating on the spindle 7 of the standard pre-existing roll-type toilet-tissue holder 1 during use.

The first apparatus 26 of the housing 14 further includes the circumferential rim 44 of the innermost end 42 of the short component 24 of the housing 14 having a circumferential detent 52 that extends axially therein and circumferentially therearound, flush with its outermost surface 54, and selectively sealingly engages with the circumferential ring 38 on the circumferential rim 30 of the innermost end 28 of the long component 22, while fitting the long component 22 of the housing 14 and the short component 24 of the housing 14 tightly together to prevent evaporation of the roll of selectively dispensable pre-moistened wipes 12 contained within the housing 14.

As shown in FIGS. 4 and 5, the core 18 is circular-cylindrically-shaped, and has a length of approximately 12 cm for fitting between the pair of posts 3 of the standard pre-existing roll-type toilet-tissue holder 1, which as mentioned supra, are spaced approximately 13 cm apart. The approximate 12 cm length of the core 18 is therefore critical and does deserve patentable weight, since it allows the housing 14 to fit between the pair of posts 3 of the standard pre-existing roll-type toilet-tissue holder 1.

The core 18 is divided into a long component 56 and a short component 58, which is shorter than, detachably attached to, and axially-aligned with, the long component 56 of the core 18, by a second apparatus 60 for selectively opening the core 18 for placement of the roll of selectively dispensable pre-moistened wipes 16 in the housing 14.

To maintain the circular cylindrical shape of the core 18, each of the long component 56 of the core 18 and the short component 58 of the core 18 is also circular-cylindrically-shaped.

The long component 56 of the core 18 is tubular, and has a length, an inner diameter, an outermost end 62 that is disposed around the perimeter 35 of, and opens into, the throughbore 34 in the outermost end wall 32 of the long component 22 of the housing 14, with the long component 56 of the core 18 extending inwardly therefrom, coaxially in the long component 22 of the housing 14, and terminates in a innermost end 64 that is open, coplanar with the innermost end 30 of the long component 22 of the housing 14, and defined by a circumferential rim 66.

The inner diameter of the long component 56 of the core 18 is approximately 2.5 cm for the snug and non-rotative reception of the spindle 7 of the standard pre-existing roll-type toilet-tissue holder 1. The approximate 2.5 cm inner diameter of the long component 56 of the core 18 is therefore critical and does deserve patentable weight, since it prevents the long component 56 of the core 18 from rotating on the spindle 7 of the standard pre-existing roll-type toilet-tissue holder 1 during use.

The second apparatus 60 of the core 18 includes the circumferential rim 66 of the innermost end 64 of the long component 56 of the core 18 having a circumferential ring 68 that extends axially therefrom and circumferentially therearound, flush with its outermost surface 70.

The short component 58 of the core 18 is tubular, and has a length, an inner diameter, an outermost end 72 that is disposed around the perimeter 49 of, and opens into, the throughbore 48 in the outermost end wall 46 of the short component 24 of the housing 14, with the short component 58 of the core 18 extending inwardly therefrom, coaxially in the short component 24 of the housing 14, and terminates in a innermost end 74 that is open, coplanar with the innermost end 42 of the short component 24 of the housing 14, and defined by a circumferential rim 76.

The inner diameter of the short component 58 of the core 18 is approximately 2.5 cm for the snug and non-rotative reception of the spindle 7 of the standard pre-existing roll-type toilet-tissue holder 1. The approximate 2.5 cm inner diameter of the short component 58 of the core 18 is therefore critical and does deserve patentable weight, since it prevents the short component 58 of the core 18 from rotating on the spindle 7 of the standard pre-existing roll-type toilet-tissue holder 1 during use.

The second apparatus 60 of the core 18 further includes the circumferential rim 76 on the innermost end 74 of the short component 58 of the core 18 having a circumferential detent 78 that extends axially therein and circumferentially therearound, flush with its outermost surface 80, and selectively sealingly engages with the circumferential ring 68 on the circumferential rim 66 of the innermost end 74 of the short component 58 of the core 18 to form a continuous opening from the throughbore 34 in the outermost end wall 32 of the long component 22 of the housing 14 to the throughbore 48 in the outermost end wall 46 of the short component 24 of the housing 14 for the non-rotative reception of the spindle 7 of the standard pre-existing roll-type toilet-tissue holder 1, while fitting the long component 56 of the core 18 and the short component 58 of the core 18 tightly together to prevent evaporation of the roll of selectively dispensable pre-moistened wipes 12 contained within the housing 14.

The long component 22 of the housing 14 further has a throughbore 82 that extends laterally therethrough for dispensing the roll of selectively dispensable pre-moistened wipes 12 therefrom, and has a perimeter 83.

The long component 22 of the housing 14 is approximately 8 cm in length and the short component 24 of the housing 14 is approximately 4 cm in length, ergo the approximate 12 cm length of the housing 14. The approximate 8 cm length of the long component 22 of the housing 14 allows enough of the roll of selectively dispensable ire-moistened wipes 12, which as discussed supra is approximately 11 cm in length, to be inserted into the long component 22 of the housing 14, without having to turn the long component 22 of the housing 14 upright to prevent the roll of selectively dispensable pre-moistened wipes 12 from falling out therefrom during loading, while leaving enough of the roll of selectively dispensable pre-moistened wipes 12 exposed, approximately 3 cm, for grabbing, if it has to be removed without having to turn the long component 22 of the housing 14 up side down and have the roll of selectively dispensable pre-moistened wipes 12 fall uncontrollably out. The approximate 8 cm length of the long component 22 of the housing 14 is therefore critical and does deserve patentable weight, since it allows the roll of selectively dispensable pre-moistened wipes 12 to be inserted into the long component 22 of the housing 14, without having to turn the long component 22 of the housing 14 upright to prevent the roll of selectively dispensable pre-moistened wipes 12 from falling out therefrom during loading, while leaving enough of the roll of selectively dispensable pre-moistened wipes 12 exposed for grabbing, if it has to be removed, without having to turn the long component 22 of the housing 14 up side down an have the roll of selectively dispensable pre-moistened wipes 12 fall uncontrollably out.

The throughbore 82 in the long component 22 of the housing 14 is approximately 6 cm from the outermost end wall 32 of the long component 22 of the housing 14, which allows each sheet of the roll of selectively dispensable pre-moistened wipes 12 to be pulled, from its center, through the throughbore 82 in the long component 22 of the housing 14, which prevents jamming and provides a smooth separation between sheets of the roll of selectively dispensable pre-moistened wipes 12, ergo the 6 cm distance of the throughbore 82 in the long component 22 of the housing 14 is one-half the assembled 12 cm length of the housing 14. The approximate 6 cm distance of the throughbore 82 in the long component 22 of the housing 14 from the outermost end wall 32 of the long component 22 of the housing 14 is therefore critical and does deserve patentable weight, since it allows each sheet of the roll of selectively dispensable pre-moistened wipes 12 to be pulled, from its center which prevents jamming and provides a smooth separation between sheets of the roll of selectively dispensable pre-moistened wipes 12.

The long component 22 of the housing 14 further has a lip 84 that extends laterally outwardly from, and circumferentially completely around, the perimeter 83 of the throughbore 82 in the long component 22 of the housing 14.

The long component 22 of the housing 14 further has a snap-on cap 86 that is flexibly attached thereto, by a molded hinge 87, in proximity of, and for selective snug engagement with, the lip 84 of the long component 22 of the housing 14, and when engaged provides an air-tight seal for the housing 14 to prevent evaporation of the roll of selectively dispensable pre-moistened wipes 12 contained therein.

The snap-on cap 86 of the long component 22 of the housing 14 selectively opens the throughbore 82 in the long component 22 of the housing 14, and when opened, allows for the smooth and even dispensing of each individual and separable wipe of the roll of selectively dispensable pre-moistened wipes 12 through the throughbore 82 in the long component 22 of the housing 14 by gently unrolling the roll of selectively dispensable pre-moistened wipes 12.

The snap-on cap 86 of the long component 22 of the housing 14 when closed, pinches the leading edge of the next individual and separable wipe of the roll of selectively dispensable pre-moistened wipes 12.

This pinching of the leading edge of the next individual and separable wipe of the roll of selectively dispensable pre-moistened wipes 12 provides an exposed leading edge of the next individual and separable wipe of the roll of selectively dispensable pre-moistened wipes 12 of several centimeters that allows a user to gently pull on and dispense a desired amount of individual and separable wipes of the roll of selectively dispensable pre-moistened wipes 12 and tear them off at the regularly-spaced full width perforations on the roll of selectively dispensable pre-moistened wipes 12, with the several centimeters drying out through evaporation but not substantially effecting the roll of selectively dispensable pre-moistened wipes 12 contained in the housing 14, because the wicking action from the interior to the exterior is negligible in view of the pinching pressure applied by the snap-on cap 86 of the long component 22 of the housing 14.

This pinching of the leading edge of the next individual and separable wipe of the roll of selectively dispensable pre-moistened wipes 12 further provides a slight slack which results in a desired lack of significant tension on the next individual and separable wipe of the roll of selectively dispensable pre-moistened wipes 12 as it unwinds from the roll of selectively dispensable pre-moistened wipes 12 and courses through the throughbore 82 in the long component 22 of the housing 14.

The roll of selectively dispensable pre-moistened wipes 12 is replaced when exhausted by:

STEP 1: Removing the refillable dispenser for replacing a standard roll of toilet tissue on a standard pre-existing roll-type toilet-tissue holder with a roll of selectively dispensable pre-moistened wipes replaceably contained therein 10 from the spindle 7 of the standard pre-existing roll-type toilet-tissue holder 1;

STEP 2: Detaching the short component 24 of the housing 14 from the long component 22 of the housing 12;

STEP 3: Inserting a new roll of selectively dispensable pre-moistened wipes 12, that has been removed from its hermetically sealed package 17, onto the long component 56 of the central core 18;

STEP 4: Pushing the leading edge of the first individual and separable wipe oL the roll of selectively dispensable pre-moistened wipes 12 up through the throughbore 32 in the long component 22 of the housing 14;

STEP 5: Snapping the snap-on cap 86 of the long component 22 of the housing 12 closed;

STEP 6: Reattaching the short component 24 of the housing 14 to the long component 22 of the housing 14; and STEP 7. Replacing the refillable dispenser for replacing a standard roll of toilet tissue on a standard pre-existing roll-type toilet-tissue holder with a roll of selectively dispensable pre-moistened wipes replaceably contained therein 10 onto the spindle 7 of the standard pre-existing roll-type toilet-tissue holder 1.

Figure 6:
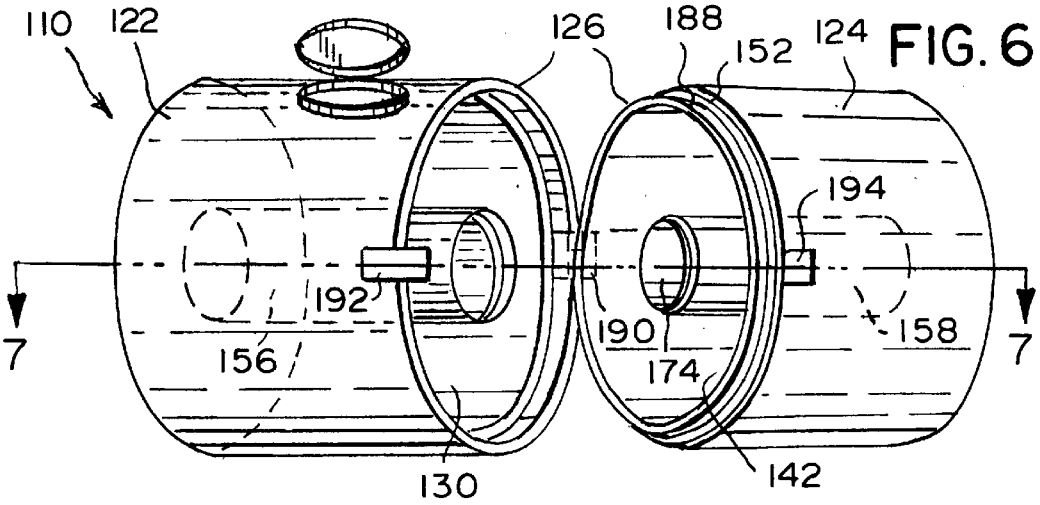
FIG. 6 is a diagrammatic perspective view of a second embodiment of the present invention.
Figure 7:
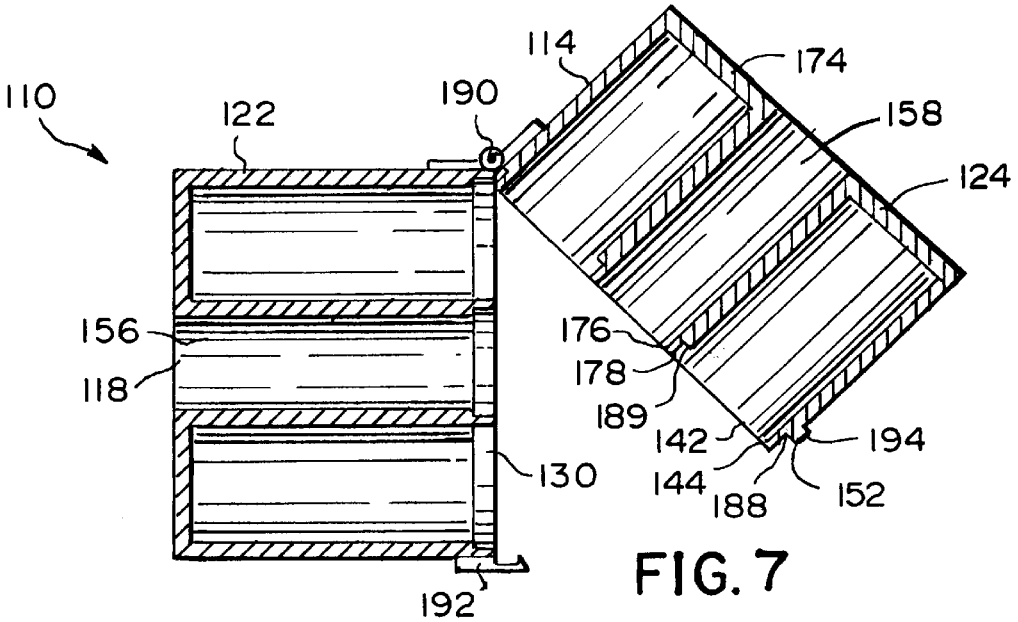
FIG. 7 is a cross sectional view taken on line 7—7 in FIG. 6.

The configuration of a second embodiment of the refillable dispenser for replacing a standard roll of toilet tissue on a standard pre-existing roll-type toilet-tissue holder with a roll of selectively dispensable pre-moistened wipes replaceably contained therein 110 can best be seen in FIGS. 6 and 7, and as such, will be discussed with reference thereto.

The second embodiment of the refillable dispenser for replacing a standard roll of toilet tissue on a standard pre-existing roll-type toilet-tissue holder with a roll of selectively dispensable pre-moistened wipes replaceably contained therein 110 is identical to the first embodiment of the refillable dispenser for replacing a standard roll of toilet tissue on a standard pre-existing roll-type toilet-tissue holder with a roll of selectively dispensable pre-moistened wipes replaceably contained therein 10, with the addition of the following components:

1) The first apparatus 126 further includes an O-ring 188 disposed in the circumferential detent 152 in the circumferential rim 144 of the innermost end 142 of the short component 124 of the housing 114, which ensures a tighter and vapor-proof seal between the long component 122 of the housing 114 and the short component 124 of the housing 114;

2) The second apparatus 160 further includes an O-ring 183 disposed in the circumferential detent 178 in the circumferential rim 176 of the innermost end 174 of the short component 158 of the core 118, which ensures a tighter and vapor-proof seal between the long component 156 of the core 118 and the short component 158 of the core 118;

3) A hinge 190 that hingedly attaches the long component 122 of the housing 114 to the short component 124 of the housing 114, which allows the long component 122 of the housing 114 and the short component 124 of the housing 114 to be pivoted open without being completely separated. The hinge 190 is disposed on the housing 114 for facing the wall 5 so as to prevent it from becoming clogged by liquid from the roll of selectively dispensable pre-moistened wipes 16 as it is dispensed forwardly;

4) A latch 192 disposed on the long component 122 of the housing 114, and extends axially past the innermost end 130 of the long component 122 of the housing 114, at a position diametrically opposed to the hinge 190, and thereby facing front for easy access; and 5) A catch 194 disposed on the short component 124 of the housing 114, at the innermost end 142 of the long component 124 of the housing 114, at a position diametrically opposed to the hinge 190, and aligned for selective engagement with, the latch 192, and thereby facing front for easy access, and when engaged by the latch 192 clamps the long component 122 of the housing 114 and the short component 124 of the housing 114 against the O-ring 188 in the circumferential detent 152 in the circumferential rim 144 of the innermost end 142 of the short component 124 of the housing 114, which assures a tight vapor proof-seal between the long component 122 of the housing 114 and the short component 124 of the housing 12 and clamps the long component 156 of the core 118 and the short component 158 of the core 118 against the O-ring 189 in the circumferential detent 178 in the circumferential rim 176 of the innermost end 174 of the short component 158 of the core 118, which assures a tight vapor-proof seal between the long component 156 of the core 118 and the short component 158 of the core 118.

Figure 8:
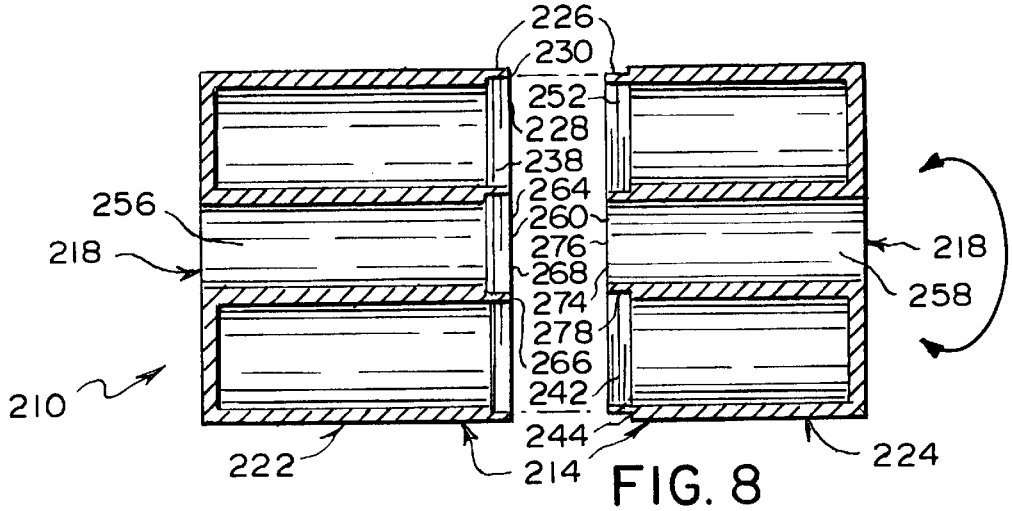
FIG. 8 is a cross sectional view of a third embodiment of the present invention.

The configuration of a third embodiment of the refillable dispenser for replacing a standard roll of toilet tissue on a standard pre-existing roll-type toilet-tissue holder with a roll of selectively dispensable pre-moistened wipes replaceable contained therein 210 can best be seen in FIG. 8, and as such, will be discussed with reference thereto.

The third embodiment of the refillable dispenser for replacing a standard roll of toilet tissue on a standard pre-existing roll-type toilet-tissue holder with a roll of selectively dispensable pre-moistened wipes replaceably contained therein 210 is similar to the first embodiment of the refillable dispenser for replacing a standard roll of toilet tissue on a standard pre-existing roll-type toilet-tissue holder with a roll of selectively dispensable pre-moistened wipes replaceably contained therein 10, except that:

1) The first apparatus 226 of the housing 214 includes the circumferential rim 230 of the innermost end 228 of the long component 222 of the housing 214 having self-sealing female threads 238 therearound, instead of the circumferential ring 38 on the circumferential rim 30 of the innermost end 28 of the long component 22 of the housing 14;
2) The first apparatus 226 of the housing 214 further includes the circumferential rim 244 of the innermost end 242 of the short component 224 of the housing 214 having self-sealing male threads 252 therearound, instead of the circumferential detent 52 on the circumferential rim 44 of the innermost end 42 of the short component 24 of the housing 14, that threadably engage with the self-sealing female threads 238 of the circumferential rim 230 of the innermost end 228 of the long component 222 of the housing 214 for assembly by engagement and rotation of the short component 224 of the housing 214 relative to the long component 222 of the housing;
3) The second apparatus 260 of the core 218 includes the circumferential rim 266 of the innermost end 264 of the long component 256 of the core 218 having self-sealing female threads 268 therearound, instead of the circumferential ring 68 on the circumferential rim 66 of the innermost end 64 of the long component 56 of the core 18; and
4) The second apparatus 260 of the core 218 further includes the circumferential rim 276 of the innermost end 274 of the short component 258 of the core 218 having self-sealing male threads 278 therearound, instead of the circumferential detent 78 in the circumferential rim 76 of the innermost end 74 of the short component 56 of the core 18, that threadably engage with the self-sealing female threads 268 around the circumferential rim 266 of the innermost end 264 of the long component 256 of the core 218 for assembly by engagement and rotation of the short component 258 of the core 218 relative to the long component 256 of the core 218.

Figure 9A:
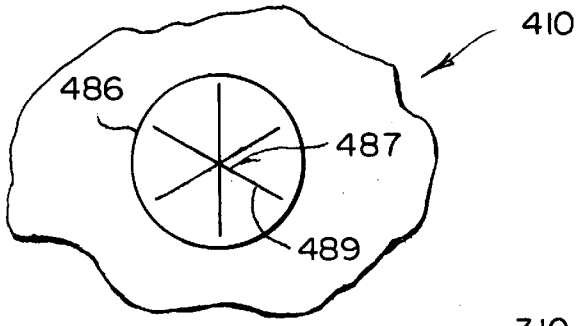
FIG. 9A is a fragmented diagrammatic top plan view of a fifth embodiment of the present invention.
Figure 9:
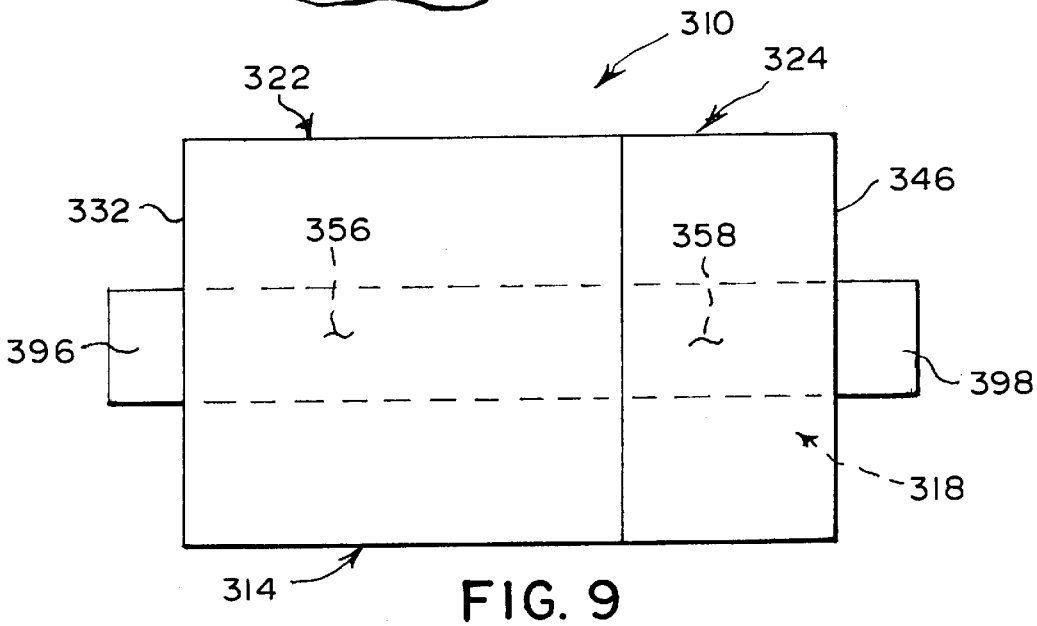
FIG. 9 is a diagrammatic side elevational view of a fourth embodiment of the present invention.

The configuration of a fourth embodiment of the refillable dispenser for replacing a standard roll of toilet tissue on a standard pre-existing roll-type toilet-tissue holder with a roll of selectively dispensable pre-moistened wipes replaceably contained therein 310 can best be seen in FIG. 9, and as such, will be discussed with reference thereto.

The fourth embodiment of the refillable dispenser for replacing a standard roll of toilet tissue on a standard pre-existing roll-type toilet-tissue holder with a roll of selectively dispensable pre-moistened wipes replaceably contained therein 310 is identical to either the first, second, or third embodiments of the refillable dispenser for replacing a standard roll of toilet tissue on a standard pre-existing roll-type toilet-tissue holder with a roll of selectively dispensable pre-moistened wipes replaceably contained therein 10, 110, 210 with the addition of:

1) A long dowel 396 that completely fills the long component 356 of the core 318, and extends outwardly past the outermost end wall 332 of the long component 322 of the housing 314, a distance sufficient for engaging the distal end 6 of one post of the pair of posts 3 of the standard roll-type toilet-tissue holder 1; and
2) A short dowel 398 that is shorter than the long dowel 396 and completely fills the short component 358 of the core 318, and extends outwardly past the outermost end wall 346 of the short component 324 of the housing 314, a distance sufficient for engaging the distal end 6 of the other post of the pair of posts 3 of the standard roll-type toilet-tissue holder 1, with the long dowel 396 and the short dowel 398 being for replacing the need for the spindle 7 of the standard roll-type toilet-tissue holder 1.

The configuration of a fifth embodiment of the refillable dispenser for replacing a standard roll of toilet tissue on a standard pre-existing roll-type toilet-tissue holder with a roll of selectively dispensable pre-moistened wipes replaceably contained therein 410 can best be seen in FIG. 9A, and as such, will be discussed with reference thereto.

The fifth embodiment of the refillable dispenser for replacing a standard roll of toilet tissue on a standard pre-existing roll-type toilet-tissue holder with a roll of selectively dispensable pre-moistened wipes replaceably contained therein 310 is identical to either the first, second, third, or fourth embodiments of the refillable dispenser for replacing a standard roll of toilet tissue on a standard pre-existing roll-type toilet-tissue holder with a roll of selectively dispensable pre-moistened wipes replaceably contained therein 10, 110, 210 310 with the exception that the cap 486 has a star-shape throughslit 487 therethrough with very thin arms 489, which allows the roll of selectively dispensable pre-moistened wipes 16 to be dispensed therethrough without removing the cap 486, with the very thin arms 489 of the star-shaped slit 487 in the cap 486 providing the required pinching discussed supra.

It is to be understood that the present invention, when sized appropriately, can be used to replace a standard roll of paper toweling on a standard pre-existing roll-type paper-towel holder with a roll of selectively dispensable pre-moistened paper toweling replaceably contained therein so as to allow the roll of selectively dispensable pre-moistened paper toweling to be readily available in virtually any kitchen and ensure its reliable and regular use instead of the standard roll of paper toweling.

For this modality, the standard pre-existing roll-type paper-towel holder comprises a pair of posts, each of which has a proximal end for attaching to a wall and a distal end for extending away from the wall. The pair of posts of the standard pre-existing roll-type paper-towel holder are substantially parallel and spaced approximately 29.5 cm apart and extend substantially perpendicularly from the wall.

The standard pre-existing roll-type paper-towel holder further comprises a spindle that has a diameter of approximately 2.5 cm and extends from the distal end of one post of the pair of posts of the standard pre-existing roll-type paper-towel holder to the distal end of the other post of the pair of posts of the standard pre-existing roll-type paper-towel holder, with at least one end of the spindle of the standard pre-existing roll-type paper-towel holder being replaceably mounted to the distal end of an associated post of the pair of posts of the standard pre-existing roll-type paper-towel holder so as to allow the spindle of the standard pre-existing roll-type paper-towel holder to be removed and placed through the standard roll of paper toweling.

The standard roll of paper toweling is approximately 27.5 cm in length, and has a hollow axial core with a diameter of approximately 4.5 cm so as to allow the standard roll of paper toweling to rotate freely on the spindle of the standard pre-existing roll-type paper-towel holder.

It will be understood that each of the elements describes above, or two or more together, may also find a useful application in other types of constructions differing from the types described above.

While the invention has been illustrated and described as embodied in a refillable dispenser for replacing a standard roll of toilet tissue on a standard pre-existing roll-type toilet-tissue holder with a roll of selectively dispensable pre-moistened wipes replaceably contained therein, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A refillable dispenser for replacing a standard roll of toilet tissue on a standard pre-existing roll-type toilet-tissue holder with a roll of selectively dispensable pre-moistened wipes replaceably contained therein so as to allow the roll of selectively dispensable pre-moistened wipes to be readily available in virtually any bathroom and ensure reliable and regular use instead of the standard roll of toilet tissue, wherein the standard pre-existing roll-type toilet-tissue holder comprises a pair of posts, each of which has a proximal end for attaching to a wall and a distal end for extending away from the wall, wherein the pair of posts of the standard pre-existing roll-type toilet-tissue holder are substantially parallel and spaced approximately 13 cm apart and extend substantially perpendicularly from the wall, wherein the standard pre-existing roll-type toilet-tissue holder further comprises a spindle that has a diameter of approximately 2.5 cm and extends from the distal end of one post of the pair of posts of the standard pre-existing roll-type toilet-tissue holder to the distal end of the other post of the pair of posts of the standard pre-existing roll-type toilet-tissue holder, with at least one end of the spindle of the standard pre-existing roll-type toilet-tissue holder being replaceably mounted to the distal end of an associated post of the pair of posts of the standard pre-existing roll-type toilet-tissue holder so as to allow the spindle of the standard pre-existing roll-type toilet-tissue holder to be removed and placed through the standard roll of toilet tissue, and wherein the standard roll of toilet tissue is approximately 11 cm in length and has a hollow axial core with a diameter of approximately 4.5 cm so as to allow the standard roll of toilet tissue to rotate freely on the spindle of the standard pre-existing roll-type toilet-tissue holder, said dispenser comprising:

a) a housing for containing a roll of selectively dispensable pre-moistened wipes, and being hollow;

b) a core passing freely through said core of said roll of selectively dispensable pre-moistened wipes for rotative motion therebetween and for non-rotatively receiving the spindle of the standard pre-existing roll-type toilet-tissue holder; said core being hollow and extending axially, concentrically, and completely through said housing; and c) a roll of selectively dispensable pre-moistened wipes having a core and being flushable and biodegradable and divided by regularly-spaced full width perforations thereacross to form a roll of individual separable wipes with leading edges; said housing being divided into a long component and a short component being shorter than, detachably attached to, and axially-aligned with said long component of said housing, by a first apparatus for selectively opening said housing for placement of said roll of selectively dispensable pre-moistened wipes therein; said long component of said housing being hollow, and having a length, an innermost axial end being opened and defined by a circumferential rim, and an outermost axial end wall being circular-shaped and having a centerline and a throughbore extending axially through said centerline of said outermost wall of said long component of said housing; said throughbore in said outermost wall of said long component of said housing having a diameter and a perimeter; said first apparatus of said housing including said circumferential rim of said innermost axial end of said long component of said housing having an outermost surface and a circumferential ring extending axially therefrom and circumferentially therearound, flush with said outermost surface of said circumferential rim of said innermost axial end of said long component of said housing; said short component of said housing being hollow, and having a length, an innermost axial end being opened and defined by a circumferential rim, and an outermost axial end wall being circular-shaped and having a centerline and a throughbore extending axially through said centerline of said outermost axial end wall of said short component of said housing; said throughbore in said outermost axial end wall of said short component of said housing having a diameter and a perimeter, with said centerline of said short component of said housing being collinear with said centerline of said long component of said housing; said core being divided into a long component and a short component being shorter than, detachably attached to, and axially-aligned with, said long component of said core, by a second apparatus for selectively opening said core for placement of said roll of selectively dispensable pre-moistened wipes in said housing; said long component of said core being tubular, and having a length, an inner diameter, an outermost axial end disposed around said perimeter of, and opening into, said throughbore in said outermost axial end wall of said long component of said housing, with said long component of said core extending inwardly therefrom, coaxially in said long component of said housing, and terminating in an innermost axial end being open, coplanar with said innermost axial end of said long component of said housing, and defined by a circumferential rim; said short component of said core being tubular, and having a length, an inner diameter, an outermost axial end disposed around said perimeter of, and opening into, said throughbore in said outermost axial end wall of said short component of said housing, with said short component of said core extending inwardly therefrom, coaxially in said short component of said housing, and terminating in a innermost axial end being open, coplanar with said innermost axial end of said short component of said housing, and defined by a circumferential rim.

2. The dispenser as defined in claim 1, wherein said housing and said core are injection molded from a material that is compatible with, and not permeable for, the liquid of said roll of selectively dispensable pre-moistened wipes, and yet maintains a dimensionally-stable component.

3. The dispenser as defined in claim 1, wherein said roll of selectively dispensable pre-moistened wipes is a continuous sheet of fibrous wiping textile having a width of approximately 10 cm, with a core having a diameter of approximately 4.5 cm for allowing free rotation of said roll of selectively dispensable pre-moistened wipes on said core.

4. The dispenser as defined in claim 1; further comprising a hermetically sealed package containing said roll of selectively dispensable pre-moistened wipes, prior to use to prevent it from drying out.

5. The dispenser as defined in claim 1, wherein said housing is circular-cylindrically-shaped for substantially replicating the standard roll of toilet tissue, and has a length of approximately 12 cm for fitting between the pair of posts of the standard pre-existing roll-type toilet-tissue holder, which are spaced approximately 13 cm apart, and to also further substantially replicate the standard roll of toilet tissue, which is approximately 11 cm in length.

6. The dispenser as defined in claim 1, wherein each of said long component of said housing and said short component of said housing is circular-cylindrically-shaped.

7. The dispenser as defined in claim 1; further comprising a long dowel completely filling said long component of said core, and extending outwardly past said outermost end wall of said long component of said housing, a distance sufficient for engaging the distal end of one post of the pair of posts of the standard roll-type toilet-tissue holder.

8. The dispenser as defined in claim 7; further comprising a short dowel being shorter than said long dowel and completely filling said short component of said core, and extending outwardly past said outermost end wall of said short component of said housing, a distance sufficient for engaging the distal end of the other post of the pair of posts of the standard roll-type toilet-tissue holder, with said long dowel and said short dowel being for replacing need for the spindle of the standard roll-type toilet-tissue holder.

9. The dispenser as defined in claim 1, wherein said diameter of said throughbore in said outermost end wall of said long component of said housing is approximately 2.5 cm for snug and non-rotative reception of the spindle of the standard pre-existing roll-type toilet-tissue holder so as to prevent said long component of said housing from rotating on the spindle of the standard pre-existing roll-type toilet-tissue holder during use.

10. The dispenser as defined in claim 1, wherein said diameter of said throughbore in said outermost end wall of said short component of said housing is approximately 2.5 cm for snug and non-rotative reception of the spindle of the standard pre-existing roll-type toilet-tissue holder so as to prevent said short component of said housing from rotating on the spindle of the standard pre-existing roll-type toilet-tissue holder during use.

11. The dispenser as defined in claim 1, wherein said first apparatus of said housing further includes said circumferential rim of said innermost end of said short component of said housing having a circumferential detent that extends axially therein and circumferentially therearound, flush with an outermost surface, and selectively sealingly engages with said circumferential ring on said circumferential rim of said innermost end of said long component, while fitting said long component of said housing and said short component of said housing tightly together to prevent evaporation of said roll of selectively dispensable pre-moistened wipes contained within said housing.

12. The dispenser as defined in claim 11, wherein said first apparatus further includes an O-ring disposed in said circumferential detent in said circumferential rim of said innermost end of said short component of said housing, which ensures a tighter and vapor-proof seal between said long component of said housing and said short component of said housing.

13. The dispenser as defined in claim 1, wherein said core is circular-cylindrically-shaped, and has a length of approximately 12 cm for fitting between the pair of posts of the standard pre-existing roll-type toilet-tissue holder, which are spaced approximately 13 cm apart.

14. The dispenser as defined in claim 1, wherein each of said long component of said core and said short component of said core is circular-cylindrically-shaped.

15. The dispenser as defined in claim 1, wherein said inner diameter of said long component of said core is approximately 2.5 cm for snug and non-rotative reception of the spindle of the standard pre-existing roll-type toilet-tissue holder so as to prevent said long component of said core from rotating on the spindle of the standard pre-existing roll-type toilet-tissue holder during use.

16. The dispenser as defined in claim 1, wherein said second apparatus of said core includes said circumferential rim of said innermost axial end of said long component of said core having an outermost surface and a circumferentially ring that extends axially therefrom and circumferentially therearound, flush with said outermost surface of said circumferential rim of said innermost axial end of said long component of said core.

17. The dispenser as defined in claim 1, wherein said inner diameter of said short component of said core is approximately 2.5 cm for snug and non-rotative reception of the spindle of the standard pre-existing roll-type toilet-tissue holder so as to prevent said short component of said core from rotating on the spindle of the standard pre-existing roll-type toilet-tissue holder during use.

18. The dispenser as defined in claim 1, wherein said second apparatus of said core further includes said circumferential rim on said innermost axial end of said short component of said core having a circumferential detent that extends axially therein and circumferentially therearound, flush with said outermost surface of said circumferential rim of said innermost axial end of said short component of said core, and selectively sealingly engages with said circumferential ring on said circumferential rim of said innermost axial end of said short component of said core to form a continuous opening from said throughbore in said outermost axial end wall of said long component of said housing to said throughbore in said outermost axial end wall of said short component of said housing for non-rotative reception of the spindle of the standard pre-existing roll-type toilet-tissue holder, while fitting said long component of said core and said short component of said core tightly together to prevent evaporation of said roll of selectively dispensable pre-moistened wipes contained within said housing.

19. The dispenser as defined in claim 18, wherein said second apparatus further includes an O-ring disposed in said circumferential detent in said circumferential rim of said innermost end of said short component of said core, which ensures a tighter and vapor-proof seal between said long component of said core and said short component of said core.

20. The dispenser as defined in claim 19; further comprising a hinge hingedly attaching said long component of said housing to said short component of said housing, and which allows said long component of said housing and said short component of said housing to be pivoted open without being completely separated from each other.

21. The dispenser as defined in claim 20, wherein said hinge is disposed on said housing for facing the wall so as to prevent said hinge from becoming clogged by liquid from said roll of selectively dispensable pre-moistened wipes as said roll of selectively dispensable pre-moistened wipes are dispensed forwardly.

22. The dispenser as defined in claim 20; further comprising a latch disposed on said long component of said housing, and extending axially past said innermost end of said long component of said housing, at a position diametrically opposed to said hinge, and thereby facing front for easy access.

23. The dispenser as defined in claim 22; further comprising a catch disposed on said short component of said housing, at said innermost axial end of said short component of said housing, at a position diametrically opposed to said hinge and aligned for selective engagement with said latch, and thereby facing front for easy access, and when engaged by said latch, clamps said long component of said housing and said short component of said housing against said O-ring in said circumferential detent in said circumferential rim of said innermost axial end of said short component of said housing, which assures a tight vapor proof-seal between said long component of said housing and said short component of said housing and clamps said long component of said core and said short component of said core against said O-ring in said circumferential detent in said circumferential rim of said innermost axial end of said short component of said core, which assures a tight vapor-proof seal between said long component of said core and said short component of said core.

24. The dispenser as defined in claim 1, wherein said circumferential rim of said innermost end of said long component of said housing has self-sealing female thread therearound.

25. The dispenser as defined in claim 24, wherein said circumferential rim of said innermost end of said short component of said housing has self-sealing male threads therearound that threadably engage with said self-sealing female threads of said circumferential rim of said innermost end of said long component or said housing for assembly by engagement and rotation of said short component of said housing relative to said long component of said housing.

26. The dispenser as defined in claim 1, wherein said circumferential rim of said innermost end of said long component of said core has self-sealing female threads therearound.

27. The dispenser as defined in claim 26, wherein said circumferential rim of said innermost end of said short component of said core has self-sealing male threads therearound that threadably engage with said self-sealing female threads around said circumferential rim of said innermost end of said long component of said core for assembly by engagement and rotation of said short component of said core relative to said long component of said core.

28. The dispenser as defined in claim 1, wherein said long component of said housing further has a throughbore that extends laterally therethrough for dispensing said roll of selectively dispensable pre-moistened wipes therefrom, and has a perimeter.

29. The dispenser as defined in claim 28, wherein said throughbore in said long component of said housing is approximately 6 cm from said outermost end wall of said long component of said housing, which allows each sheet of said roll of selectively dispensable pre-moistened wipes to be pulled, from a center, through said throughbore in said long component of said housing, which prevents jamming and provides a smooth separation between sheets of said roll of selectively dispensable pre-moistened wipes, since said 6 cm distance of said throughbore in said long component of said housing is one-half assembled 12 cm length of said housing.

30. The dispenser as defined in claim 28, wherein said long component of said housing further has a lip that extends laterally outwardly from, and circumferentially completely around, said perimeter of said throughbore in said long component of said housing.

31. The dispenser as defined in claim 30, wherein said long component of said housing further has a snap-on cap that is flexibly attached thereto, by a molded hinge, in proximity of, and for selective snug engagement with, said lip of said long component of said housing, and when engaged provides an air-tight seal for said housing to prevent evaporation of said roll of selectively dispensable pre-moistened wipes contained therein.

32. The dispenser as defined in claim 31, wherein said snap-on cap of said long component of said housing selectively opens said throughbore in said long component of said housing, and when opened, allows for smooth and even dispensing of each individual and separable wipe of said roll of selectively dispensable pre-moistened wipes through said throughbore in said long component of said housing by gently unrolling said roll of selectively dispensable pre-moistened wipes.

33. The dispenser as defined in claim 31, wherein said snap-on cap of said long component of said housing when closed, pinches said leading edge of said next individual and separable wipe of said roll of selectively dispensable pre-moistened wipes, which provides an exposed leading edge of said next individual and separable wipe of said roll of selectively dispensable pre-moistened wipes of several centimeters that allows a user to gently pull on and dispense a desired amount of individual and separable wipes of said roll of selectively dispensable pre-moistened wipes and tear them off at said regularly-spaced full width perforations on said roll of selectively dispensable pre-moistened wipes, with said several centimeters drying out through evaporation but not substantially effecting said roll of selectively dispensable pre-moistened wipes contained in said housing, because wicking action from inside to outside said housing is negligible in view of said pinching pressure applied by said snap-on cap of said long component of said housing.

34. The dispenser as defined in claim 33, wherein said pinching of said leading edge of said next individual and separable wipe of said roll of selectively dispensable pre-moistened wipes further provides a slight slack which results in a desired lack of significant tension on said next individual and separable wipe of said roll of selectively dispensable pre-moistened wipes as the wipes unwinds from said roll of selectively dispensable pre-moistened wipes and courses through said throughbore in said long component of said housing, with said roll of selectively dispensable pre-moistened wipes being replaced when exhausted by first removing said refillable dispenser for replacing a standard roll of toilet tissue on a standard pre-existing roll-type toilet-tissue holder with a roll of selectively dispensable pre-moistened wipes replaceably contained therein from the spindle of the standard pre-existing roll-type toilet-tissue holder, then detaching said short component of said housing from said long component of said housing, then inserting a new roll of selectively dispensable pre-moistened wipes, that has been removed from a hermetically sealed package, onto said long component of said central core, then pushing said leading edge of said first individual and separable wipe of said roll of selectively dispensable pre-moistened wipes up through said throughbore in said long component of said housing, then snapping said snap-on cap of said long component of said housing closed, then reattaching said short component of said housing to said long component of said housing, and then finally replacing said refillable dispenser for replacing a standard roll of toilet tissue or a standard pre-existing roll-type toilet-tissue holder with a roll of selectively dispensable pre-moistened wipes replaceably contained therein onto the spindle of the standard pre-existing roll-type toilet-tissue holder.

35. The dispenser as defined in claim 31, wherein said cap has a star-shaped throughslit therethrough with very thin arms, which allows said roll of selectively dispensable pre-moistened wipes to be dispensed therethrough without removing said cap, with said very thin arms of said star-shaped slit in said cap providing required pinching.

36. The dispenser as defined in claim 1, wherein said long component of said housing is approximately 8 cm in length and said short component of said housing is approximately 4 cm in length, which allows enough of said roll of selectively dispensable pre-moistened wipes, which is approximately 11 cm in length, to be inserted into said long component of said housing, without having to turn said long component of said housing upright to prevent said roll of selectively dispensable pre-moistened wipes from falling out therefrom during loading, while leaving enough of said roll of selectively dispensable pre-moistened wipes exposed, approximately 3 cm, for grabbing, without having to turn said long component of said housing up side down and have said roll of selectively dispensable pre-moistened wipes fall uncontrollably out.

* * * * *